US005163629A

United States Patent [19]

Raterman et al.

[11] Patent Number: 5,163,629

[45] Date of Patent: Nov. 17, 1992

[54] SHREDDER CUTTING DISCS

[75] Inventors: Donald E. Raterman, Deerfield; James M. Amburn, Mundelein; Heinz W. Schrieter, Skokie, all of Ill.

[73] Assignee: Cummins-Allison Corp., Mt. Prospect, Ill.

[21] Appl. No.: 694,381

[22] Filed: May 1, 1991

[51] Int. Cl.[5] ..... B02C 18/06

[52] U.S. Cl. ..... 241/236; 241/167

[58] Field of Search ..... 241/166, 167, 236, 295

[56] References Cited

U.S. PATENT DOCUMENTS

| | | | |
|---|---|---|---|
| 3,201,066 | 8/1965 | Danforth | 241/236 X |
| 3,860,180 | 1/1975 | Goldhammer | 241/236 X |
| 4,619,411 | 10/1986 | Izzard | 241/236 X |
| 4,693,428 | 9/1987 | Raterman et al. | 241/236 X |

*Primary Examiner*—Douglas D. Watts

*Attorney, Agent, or Firm*—Arnold, White & Durkee

[57] ABSTRACT

A shredding device uses a plurality of interleaving, counter-rotating discs to reduce sheets of material into longitudinal strips. One or more parallelogram or diverging configured notches, formed in the periphery of each disc, cut the longitudinal strips into segments. Deflectors disposed in the spaces between each disc clear unwanted material from between the discs.

10 Claims, 4 Drawing Sheets

SHREDDER CUTTING DISCS

BACKGROUND OF THE INVENTION

A. Field of the Invention

This invention relates generally to shredding machines, and more particularly to cutting discs for shredding machines which cut sheet materials in transverse directions.

B. Description of the Background Art

Most paper shredders employ a pair of counter-rotating rollers having a plurality of interleaved cutting elements. The cutting elements generally conform to one of two categories, toothed discs and smooth-surface discs of right cylindrica configuration. Shredders employing toothed discs are typically constructed by attaching a plurality of discrete toothed discs and interspersed spacers to a shaft. Shredders employing smooth-surfaced discs are typically constructed by milling a piece of roll stock to form a plurality of spaced apart discs. The latter construction technique is preferable since the entire machining process is conducive for use with fully automated milling machines.

Both types of shredders function similarly. As shreddable material, such as paper, is fed between the counter-rotating rolls, the interleaved cutting elements cut or tear the material into longitudinal strips using a scissor-like action. One example of a smooth-surfaced disc shredder is disclosed in U.S. Pat. No. 3,630,460. The shredder disclosed in this patent includes a plurality of interleaved, counter-rotating discs which cut sheet material into strips using a scissor-like action. The teeth of the toothed discs or grooves in the smooth discs grip the material and pull it between the juxtaposed rollers to produce tension in the material which facilitates shredding. U.S. Pat. No. 3,033,064 discloses a shredder having a plurality of notched discs. The notches grip sheets of paper to advance them between the rollers where the interleaved counter-rotating discs cut the paper into strips.

In many applications, however, such as governmental document destruction, this type of destruction proves inadequate. There is the possibility that the content of these waste documents can be reconstructed since characters remain on the stips. Therefore, each type of shredder has been improved to shred materials in both the longitudinal and lateral directions. U.S. Pat. No. 4,565,330 discloses a toothed disc shredder which uses teeth to draw the sheet materials between the shredding rolls and cut the material in two directions. As the circumferential edges of the discs cut the material into strips, the teeth, in cooperation with a back plate, cut the strips into chips. U.S. Pat. No. 3,860,180 discloses a smooth-surfaced disc shredder including notches formed in the outer periphery of each disc such that the notches are disposed in a helical fashion around each roll. As the circumferential edges of the discs cut the sheet material into strips, the leading edge of the notches cut the material strips into segments.

Although the above-mentioned techniques usually destroy documents satisfactorily, they demonstrate some inadequacies. For example, some shredders use "metal-to-metal" contact to cut strips into segments. This contact causes a significant amount of wear on the discs and rollers. Moreover, this segmenting technique produces relatively more stress between the rollers. Other shredders must hold the sheet material tautly in order for a sharp nose of the trailing edge of the notch to penetrate and cut the material into segments. If the material is loose or too thick, the nose of the notch will not be able to segment the strips. For example, a shredder using notched discs is disclosed in U.S. Pat. No. 4,944,462, which is incorporated by reference herein. This shredder uses notches that are wider at the bottom than at the peripheral edge of the disc. The cutting or shredding action of these discs is significantly superior to those known previously; however, discs of this type experience retention of particles in the notches. These retained particles are randomly discharged from the notches into parts of the shredder increasing the possibility of jamming or fouling other components of the shredder.

SUMMARY OF THE INVENTION

Briefly, the present invention is directed to a new and improved cutting disc for a shredder used to shred sheet material. The shredder or shredding device includes first and second parallel shafts mounted for rotation in opposite directions. A first plurality of cutting discs are fixed or secured onto the first shaft to rotate with that shaft. These discs are spaced at intervals along the length of the first shaft. A second plurality of cutting discs are fixed on the second shaft and rotate with that shaft. These discs are also spaced at intervals along the length of the second shaft in order to interleave with the first plurality of cutting discs. The periphery of each of the discs defines shredding blades. At least one notch is formed in the periphery of each cutting disc so that each of the notches includes parallel sides extending at an angle to a radius of the cutting discs forming a cutting point.

As sheet material passes between the counter-rotating shafts, the interleaving cutting discs cut the sheet material in a longitudinal direction, which is perpendicular to the axes of the shafts. The cutting notch in each disc extends transversely across the periphery of the disc, and cuts the sheet material in a direction parallel to the axes of the shafts. Thus, the shredded sheet is cut in two directions by a combination of the interleaving cutting discs and the notches formed in the periphery of each disc.

To shred larger volumes of paper or the like, the outer periphery of each disc forms a V-shape to produce sharp axial edges. The sharp axial edges of the interleaving discs produce a sharper cutting edge for cutting material in the longitudinal direction. When the periphery contains a V-shaped notch, as described above, the pointed portion includes two cutting points. The cutting points penetrate into the sheet material, and improve the transverse cutting action of the device.

In one embodiment the notches are of a parallelogram configuration, and in a second embodiment the notches are of a configuration including diverging sides. In both embodiments, particles are not retained in the notches, thereby lessening the likelihood of particles being discharged into portions of the shredding device and causing jamming or break down of the device.

BRIEF DESCRIPTION OF THE DRAWINGS

Other objects and advantages of the invention will become apparent upon reading the following detailed description and upon reference to the drawings in which.

Figure 1:
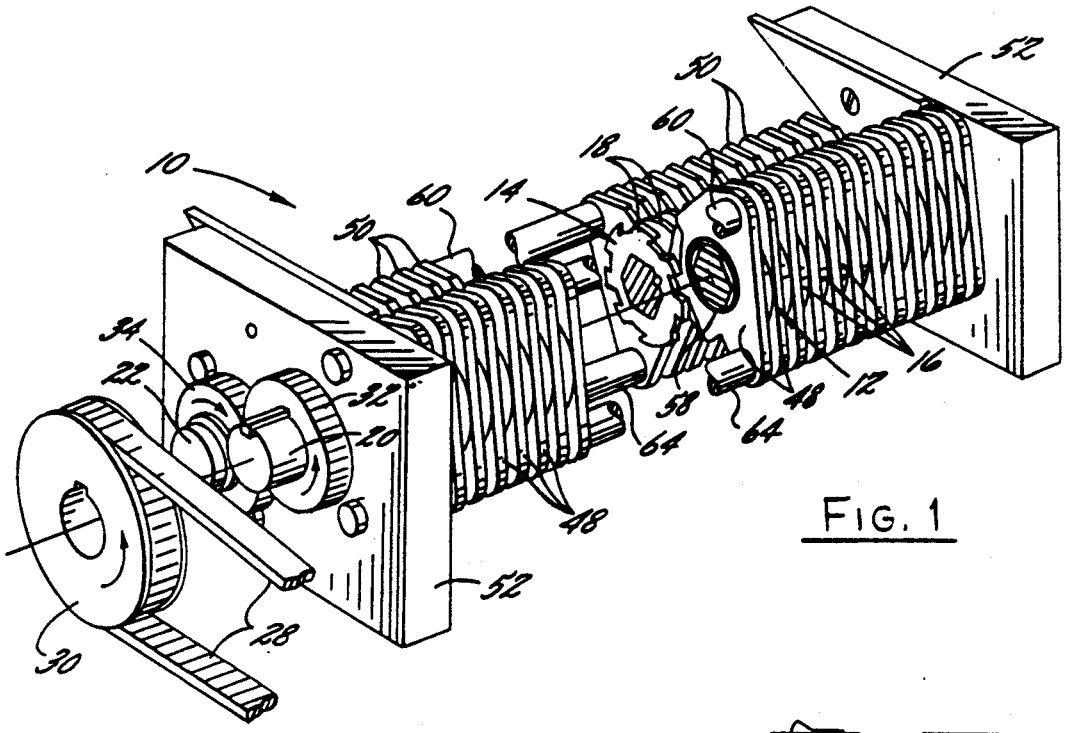
FIG. 1 is a perspective view of a shredding device employing the present invention.

While the invention is susceptible to various modifications and alternative forms, specific embodiments thereof have been shown by way of example in the drawings and will be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENT

Referring initially to FIG. 1, a device 10 for shredding sheet material is shown in a perspective illustration. The device 10 includes a pair of rollers 12, 14 which are rotatably mounted opposite one another on bearings with the axes of rotation parallel to one another. The rollers 12, 14 are geared to rotate in opposite directions, i.e., counter-rotate. A plurality of cutting discs 16, 18 are fixed on each roller shaft 20, 22, respectively, at spaced intervals along the length of each shaft 20, 22. The spaced intervals are selected so that the discs 16 on the shaft 20 interleave with the discs 18 on the other shaft 22. Shreddable materials which pass between the interleaving, counter-rotating discs 16, 18 are cut by the cooperating discs.

Figure 2:
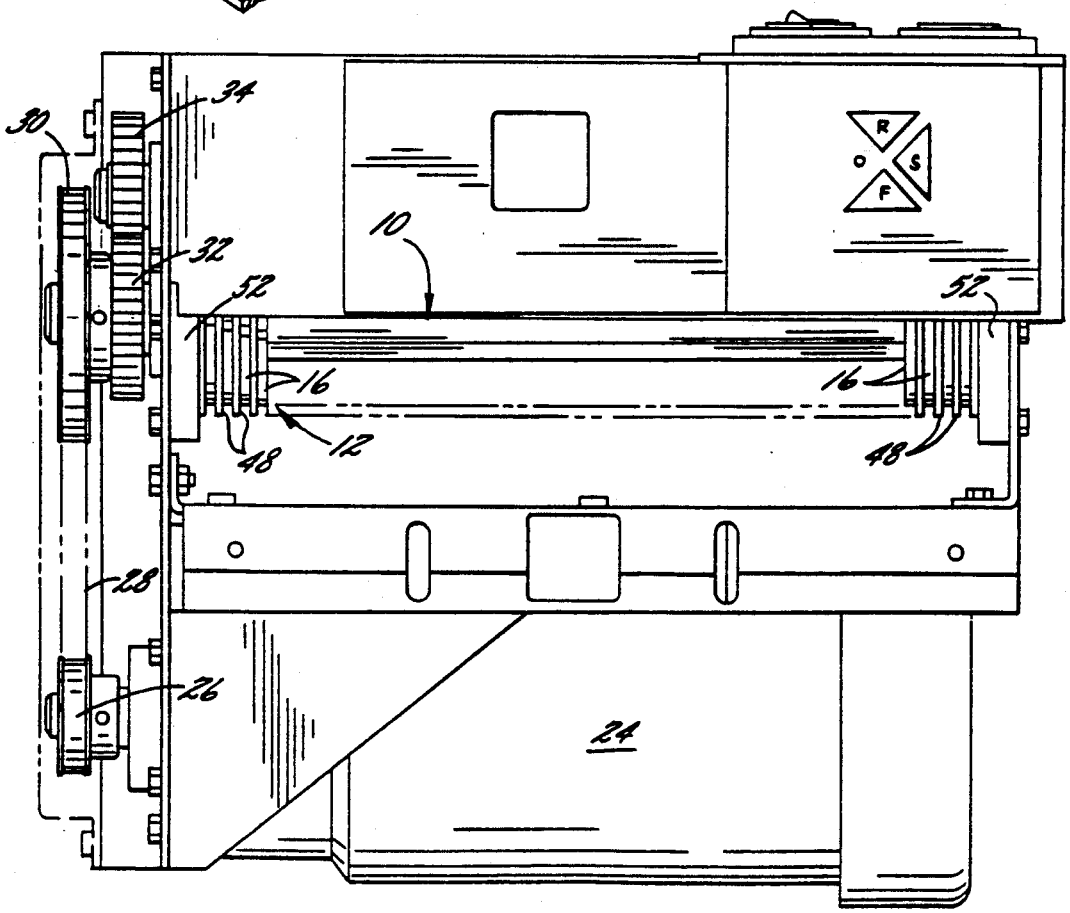
FIG. 2 is a top plan view of a shredding device embodying the present invention.

The shredding device 10 uses a motor 24 to drive a sprocket 26 (FIG. 2). To transfer the driving force to the rollers 12, 14, a belt or chain 28 connects the sprocket 26 to a sprocket 30 which is attached to one end of one of the rollers 12. A gear 32 fixed on the driven roller 12 meshes with a gear 34 fixed on the other roller 14 so that each roller counter-rotates with respect to the other. Preferably, these gears 32, 34 are substantially identical so the rollers 12, 14 operate at the same speed. However, should an application require one roller to rotate faster than the other roller, one need simply fit an appropriate gear onto one of the shafts 20, 22. For most applications, however, the rollers 12, 14 rotate at the same speed of about 30 to 60 lineal feet per minute.

Figure 3:
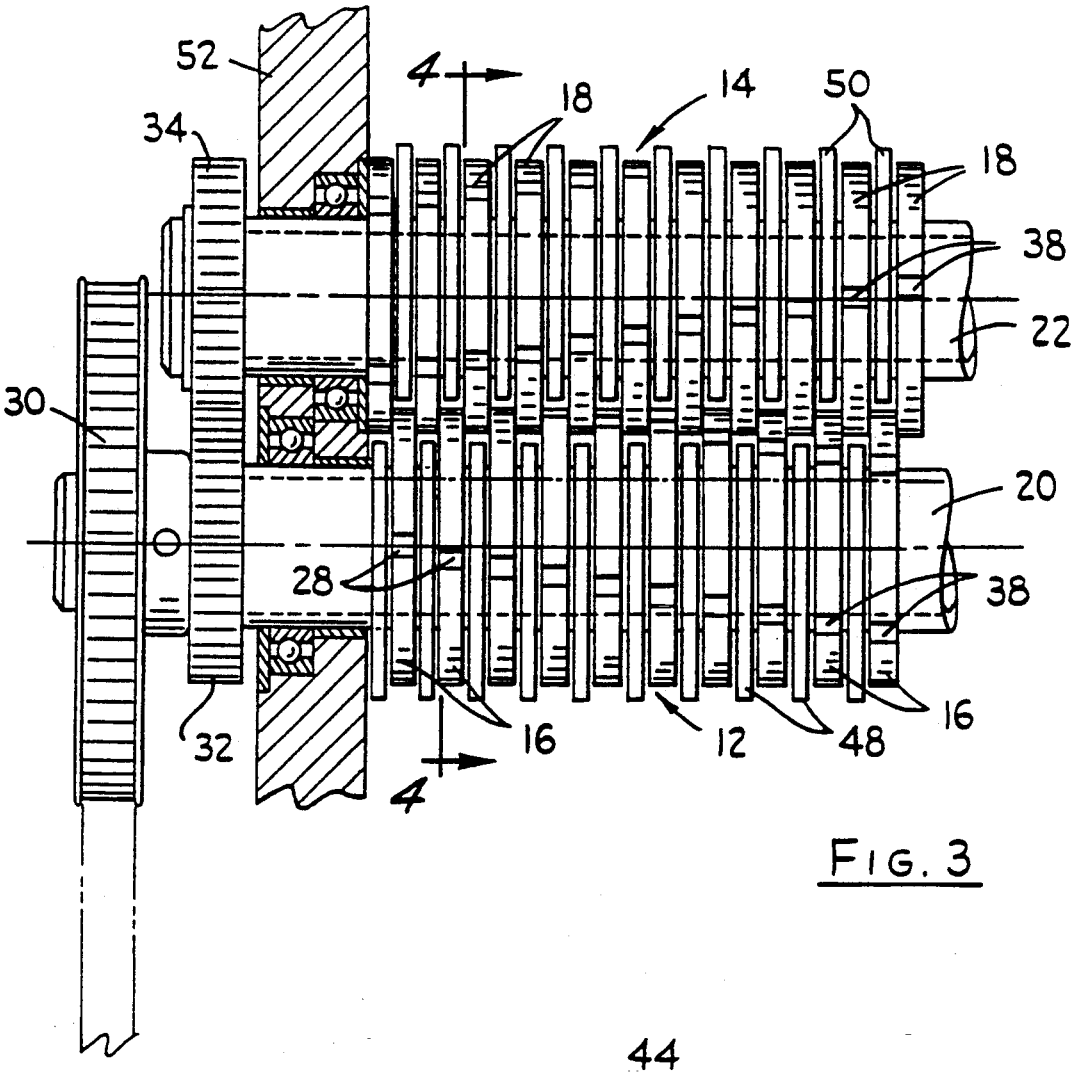
FIG. 3 is a plan view of a pair of shredder rollers embodying the present invention.
Figure 4:
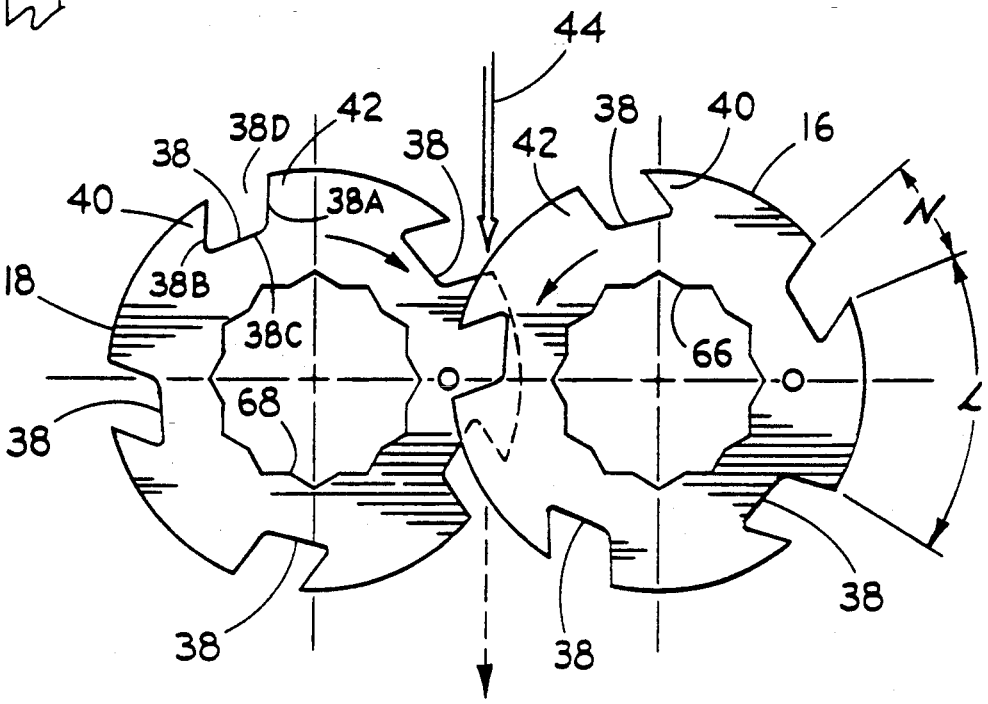
FIG. 4 is a cross-sectional view taken along line 4—4 in FIG. 3.
Figure 5:
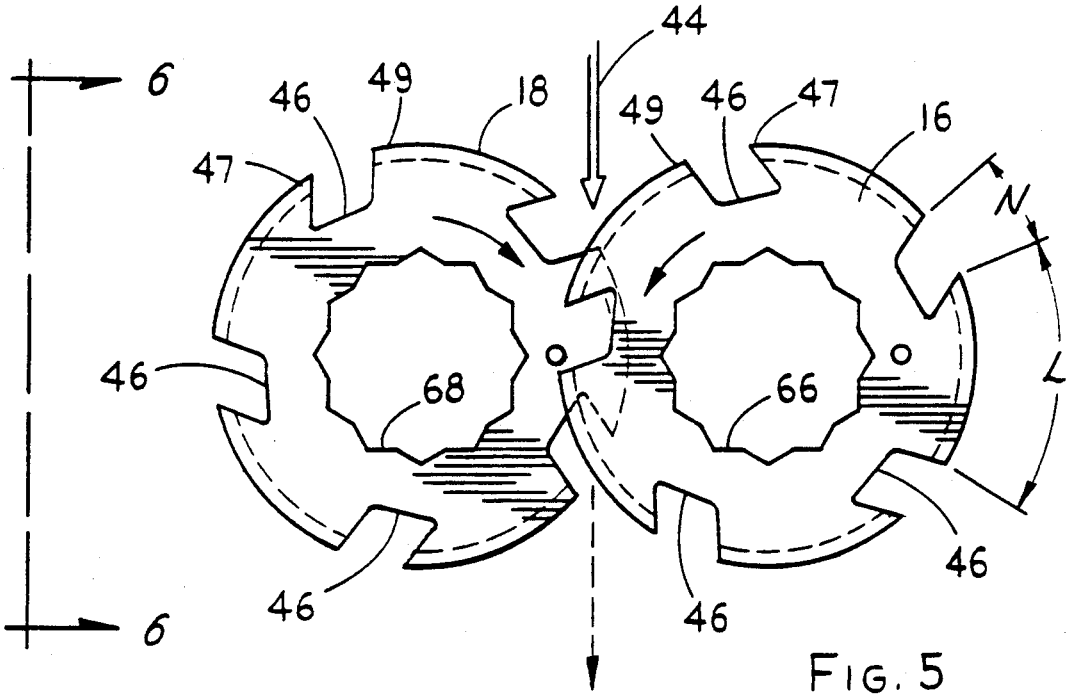
FIG. 5 is a view similar to FIG. 4 of an alternative embodiment of the present invention.

As the rollers 12, 14 counter-rotate, the interleaving discs 16, 18 shown in FIGS. 3, 4 and 5, cut sheet materials 44 passing between the rollers 12, 14 into longitudinal strips. The axial edges of each disc 16 are positioned within the spaced intervals formed between the discs 18 on the opposite shaft. This interleaving arrangement places the axial edge of one disc 16 adjacent to the axial edge of an opposing disc 18 to form a scissor-like cutting tool. The interleaving discs 16, 18 place the sheet material under tension so that the scissor-like cutting action of the discs 16, 18 tears through the material. Preferably, the axial thickness of each disc 16, 18 is slightly less than the space between adjacent discs to allow the opposing discs to interleave while keeping them closely adjacent for optimum cutting action. The axial thickness of each disc 16, 18 also determines the width of the strip produced by the cutting rollers 12, 14. For materials, such as confidential documents, which require unreconstructable destruction, thinner discs cut material into thinner strips for more complete destruction. The majority of shredding applications utilize discs of about 0.100 inches to about 0.300 inches in thickness.

Most sheet materials, such as paper or cardboard, have an inherent rigidity which allows them to be cut in this scissor-like fashion, and which prevents the materials from wrapping around the interleaving discs instead of shredding. Materials, such as thin plastic or onion skin paper, have poor rigidity and are often torn unevenly, or not at all, by shredding devices. Therefore, enhancing the piercing or cutting force of the shredding device 10 improves its ability to cut extremely thick or very thin materials.

Figure 6:
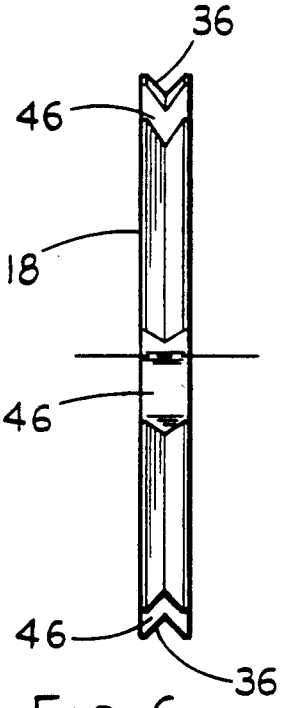
FIG. 6 is a view taken along line 6—6 in FIG. 5.
Figure 7:
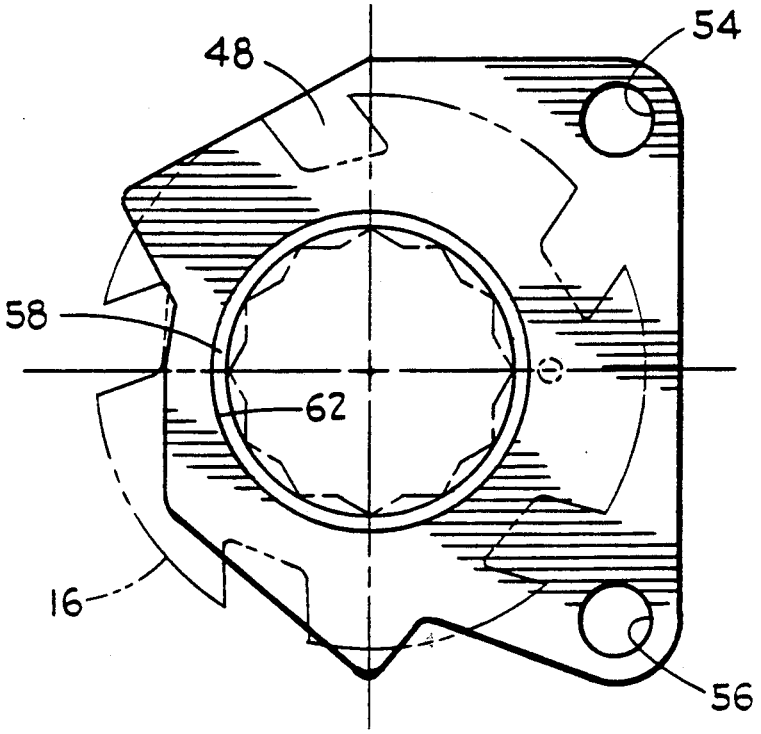
FIG. 7 is a side view of a cutting disc and deflector.

For cutting thicker volumes of material or very thin material FIG. 6 shows an end view of a disc 16, 18 which has a V-shaped peripheral edge 36. The V-shaped edge 36 provides a sharper edge than conventional smooth-surfaced discs which have 90° edges. The adjacent axial V-shaped edges 36 of the interleaving discs 16, 18 improve the cutting effect of the rollers 12, 14 because the sharper V-shaped edges exert more force per unit area than the conventional 90° edges. These sharper edges reduce the dependence of the shredding device 10 on the rigidity of the sheet material. Moreover, the V-shaped edge 36 provides a greater amount of space between the periphery of the discs 16, 18 and the outer surface of the deflectors 48. This produces less stress between the rollers 12, 14 during shredding, and, therefore, allows the device 10 to shred greater thicknesses of sheet material as compared to similar smooth-surfaced shredders. More detail on a shredder with cutting discs including a V-shaped edge can be obtained from U.S. Pat. No. 4,944,462 assigned to the assignee of this invention and this patent is incorporated by reference.

To destroy a document such that it cannot be reconstructed, it is preferable to cut it in two directions. As illustrated in FIG. 4, notches 38 are formed in the periphery of each disc 16, 18 to cut the longitudinal strips laterally into segments or chips. The notches 38 are generally of the same width at the root 38C as at the mouth 38D at the periphery of each disc 16, 18. As shown, the notches 38 are in the form of a parallelogram where a base of the parallelogram or root 38C of the notch 38 is nearer the center of the disc than an opposite base of the parallelogram, which is the mouth 38D of the notch. Two sides 38A and 38B of the parallelogram define the sides of each notch 38 and are preferably at an angle of about 24° to a radius of each disc 16 and 18.

As the rollers 12, 14 rotate in the direction shown by the arrows in FIG. 4, the pointed portion 40 of the notch 38 which is pointing in the direction of rotation cuts laterally through the sheet material 44. The lateral incisions formed by the pointed portion 40 are perpendicular to the longitudinal incisions since the edge of the pointed portion 40 is parallel to the axes of rotation of the shafts 20, 22. The lateral incision is made first, and the longitudinal cut is made as the sheet material continues through the rollers 12, 14. Therefore, the sheet material 44 is under longitudinal tension as the lateral incision is made.

FIG. 5 illustrates a parallelogram notch 46 formed in a disc 16 having a V-shaped periphery. The notch 46 is capable of cutting through thicker and tougher materials than the same notch 38 formed in a disc having a smooth or flat periphery. While the notch 38 formed in the periphery of a smooth-surfaced disc cuts materials with a blade-like edge, the similar notch 46 formed in the V-shaped periphery 36 of a disc 16 cuts sheet materials 44 with a double-pointed edge 47. The double-pointed edge 47 exerts more force onto the same area of sheet material, so that the edge penetrates the sheet material better and cuts the longitudinal strips into segments more efficiently. As can be seen in FIG. 5, the double-pointed edge 47 of the notch 46 contacts the sheet material as the discs 16, 18 intersect. The transverse cut is made first, and the longitudinal cut is made as the sheet material continues through the rollers 12, 14. The depth of the V generally determines the thickness of the sheet material which can be effectively cut transversely. Deeper V-shapes cut thicker volumes of sheet material, but tend to be more susceptible to damage than shallower V-shapes, The discs 16, 18 are preferably about 3 inches in diameter, and the depth of the V-shape is about .045 inches to about .100 inches. It should be note that a V-shaped edge which is too deep may have difficulty transversely cutting the sheet material before the longitudinal cut intersects with the transverse cut. In this instance the transverse cut may occasionally not be completed since the longitudinal tension of the sheet lessens when the cuts intersect.

The interleaving discs 16, 18 will efficiently cut sheet materials in both the longitudinal and lateral directions given the proper timing between the discs on the opposing shafts. FIGS. 4 and 5 illustrate opposing discs 16, 18 where a notch N on one disc 16 properly overlaps with a land L on the other disc 18. In contrast, if a notch of one disc 16 overlaps with a notch of the other disc 18, there will be no scissor-like cooperation between the opposing discs, and, therefore, no longitudinal incision will be made. Hence, the belt 30 and the gears 32 and 34 are selected to properly rotate the plurality of discs 16, 18 which are fixed in a preselected pattern of the shafts 20, 22. The discs 16, 18 are mounted and rotated such that each double-pointed edge 47 is aligned between two lands L of discs on both sides of the disc as the sheet material 44 is about to be cut. This positioning ensures that the sheet material 44 to be cut extends between the two lands and is held in tension in the path of each edge 47. Each edge 47 then easily pierces the sheet material starting the cutting or shredding action. In addition, the discs 16 and 18 include twenty-four sided, central apertures 66 and 68, respectively. These apertures 66 and 68 fit over the shafts 20 and 22 which are of a hexagonal cross-section. This configuration of the apertures 66, 68 allows each disc 16 and 18 to be rotated in increments of 6° producing a helical pattern of the notches and avoiding even a slight overlap of a notch on the disc 16 with a notch on the disc 18.

The parallelogram shape of the notches 38 and 46 overcomes a clogging or retention problem experienced in the prior art. In cutting discs with notches that are wider on the bottom or root than the top or mouth at the periphery of the discs it is common for cut strips or particles to be retained in the notches. These particles are often released randomly and at a location within the shredding device that clogs or jams the electronics or other components of the shredding device thereby necessitating frequent servicing. It has been determined that a notch with a top or mouth as wide as or wider than its root does not retain the strips or particles, thereby avoiding clogging of and damage to the shredding device.

Figure 8:
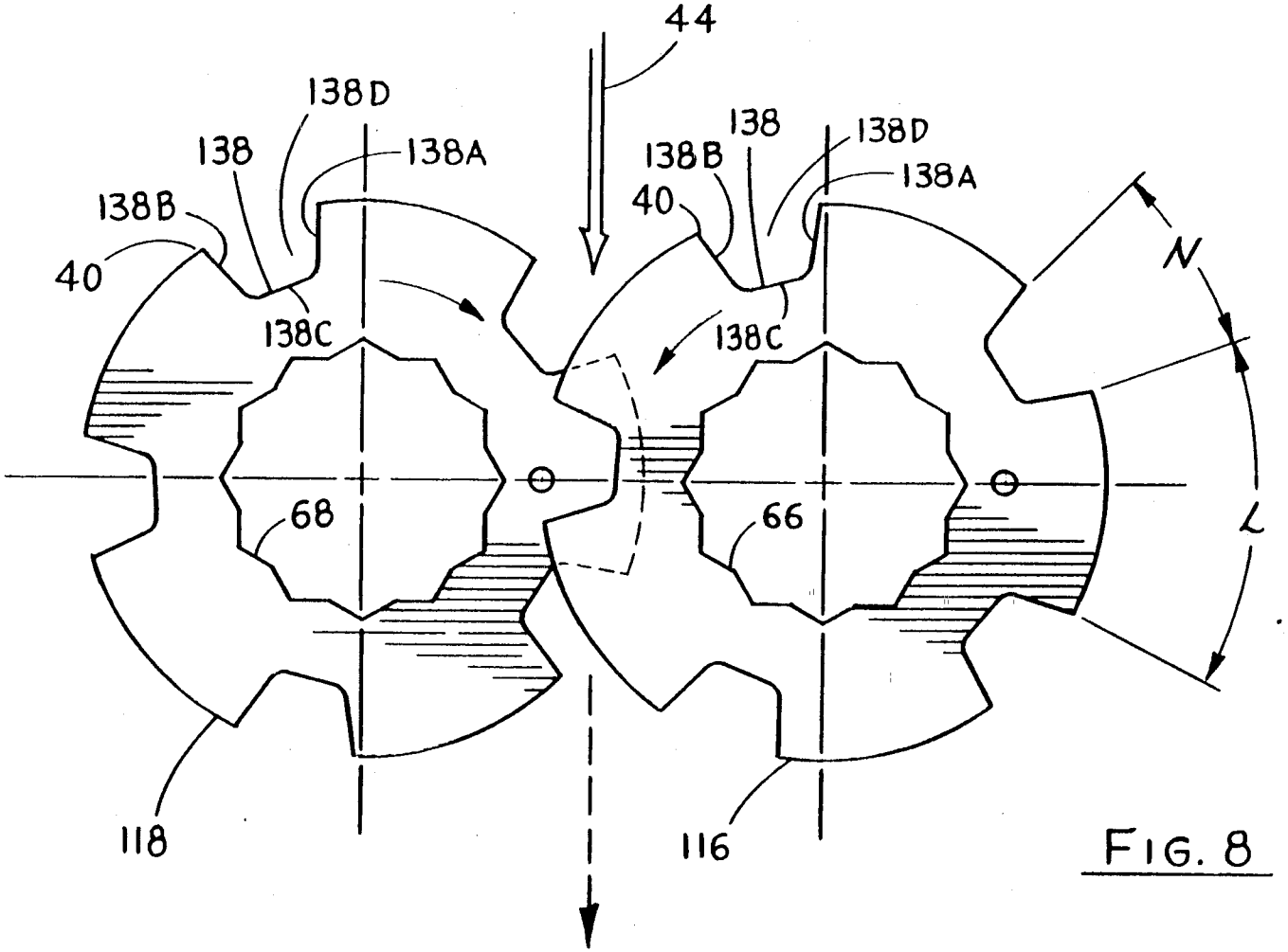
FIG. 8 is a view similar to FIG. 4 illustrating another alternative embodiment of the present invention.

An alternative notch that also overcomes the problem of particle retention is included in the cutting discs 116 and 118 illustrated in FIG. 8. The discs 116 and 118 include notches 138 with divergent sides 138A and 138B. As a result, the mouth 138D of each notch 138 is wider than the root 138C. This divergent configuration of the notches 138 does not retain particles, thereby lessening the liklihood that particles will clog or damage the shredding device.

To maintain a relatively constant torque on the driving motor 24 during shredding, the notches 38, 46 and 138 form a helical pattern along the rollers 12, 14. This pattern distributes the transverse cutting action of the rollers 12, 14 so that a substantially equal number of transverse cuts are being made constantly. The relatively constant cutting action prevents undue stress on the device 10, and allows the use of a smaller motor to keep the device 10 light and compact enough for office use.

Referring again to FIGS. 4 and 5, it has been found that if the circumferential measurement L of lands 39, which separate the respective notches 38, 46 and 138 on a disc 16, 18, is two to four times greater than the circumferential measurement N of the notches 38, 46, and 138 then the shredded material does not tend to accumulate between the interleaved discs 16, 18. Since the accumulation of shredded material between the discs 16, 18 lowers the efficiency of the device 10 and causes jams, a proper ratio of L:N improves the performance of the device 10 and reduces down-time for clearing jams.

Preferably, the discs 16, 18 are discrete discs, and are attached to a discrete shaft. A disc 16, 18 is stamped into the general notched shape, and then ground to produce a finished disc. The discs are spaced apart by a plurality of discrete spacers 58 which fit within an aperture 62 in the deflectors 48, 50.

As the rollers 12, 14 counter-rotate and shred materials, the shredded materials can become compressed in the spaces between the discs 16, 18. To clean material from the rollers 12, 14 during normal operation, deflectors 48, 50 fit into the spaces between the discs 16, 18 on the respective shafts 20, 22. (See FIG. 3). The deflectors 48, 50 are attached to rods 60, 64 on the frame 52 of the device 10 by mounting holes 54, 56 so that the deflectors 48, 50 are positioned to remove the compressed material from the rollers 12, 14. Torn material in the notches 38, 46, and 138 may extend beyond the axial edges of the discs 16, 18, so the deflectors 48, 50 are positioned so that the material extracted by the deflectors 48, 50 falls into a bin or similar container along with the rest of the shredded material.

Alternatively, the rollers 12, 14 may be fabricated from a piece of solid roll stock using a milling process. Numerical control machines currently on the market are easily programmed to mill circumferential slots automatically in a piece of roll stock to form the individual discs. The cutting tool of the automatic milling machine can be placed at the proper angles to mill notches into the peripheries of the discs to produce a parallelogram or divergent notch. To decrease the weight of the device 10, the center of the shafts 20, 22 may be bored out without affecting the strength of the rollers 12, 14.

We claim:

1. A device for shredding sheet material, comprising:

first and second parallel shafts mounted for rotation in opposite directions;

a first plurality of discs fixed on said first shaft for rotation therewith and spaced at intervals along the length of said first shaft;

a second plurality of discs fixed on said second shaft for rotation therewith and spaced at intervals along the length of said second shaft to interleave with said first plurality of discs;

at least one notch formed in the periphery of each disc, each said notch having a root and a mouth, each said notch including opposed sides which are divergent from each other;

a first plurality of deflectors being disposed about said first shaft within the spaced intervals between said plurality of discs on said first shaft; and a second plurality of deflectors being disposed about said second shaft within the spaced intervals between said plurality of discs on said second shaft.

2. The device as set forth in claim 1 wherein said deflectors prevent accumulation of shredded material between adjacent discs on said respective shafts.

3. The device as set forth in claim 2 wherein:

said notches are distributed in rows along the length of said shaft in a helical pattern.

4. The device as set forth in claim 1 wherein:

one side of said notch forms a pointed portion;

said rotating, interleaving discs cut sheet material passing therebetween into longitudinal strips, and each of said pointed portions which point in the direction of rotation cuts the longitudinal strips laterally.

5. The device as set forth in claim 1 wherein;

said mouth is wider than said root.

6. A device for shredding sheet material, comprising:

first and second parallel shafts mounted for rotation in opposite directions;

a first plurality of discs fixed on said first shaft for rotation therewith and spaced at intervals along the length of said first shaft;

a second plurality of discs fixed on said second shaft for rotation therewith and spaced at intervals along the length of said second shaft to interleave with said first plurality of discs; and at least one notch formed in the periphery of each disc, each said notch having a root and a mouth, with the width of said root being at least as wide as the width of said mouth, the periphery of each of said first and second plurality of discs having a V-shaped cross-section to form dual shredding blades at the axial edges of each disc.

7. A device for shredding sheet material, comprising;

first and second parallel shafts mounted for rotation in opposite directions;

a first plurality of discs fixed on said first shaft for rotation therewith and spaced at intervals along the length of said first shaft;

a second plurality of discs fixed on said second shaft for rotation therewith and spaced at intervals along the length of said second shaft to interleave with said first plurality of discs;

at least one notch in the periphery of each of said first plurality of discs and of each of said second plurality of disc; each said notch having a root and a mouth, each said notch including opposed sides extending at an angle to a radius of each disc with the width of said root being at least as wide as the width of said mouth;

and a V-shaped cross-section in the periphery of each said first and second plurality of discs to form dual shredding blades at the axial edges of each disc and to form a double-pointed edge on each said notch.

8. The device for shredding claimed in claim 7 wherein each of said first and second plurality of discs further includes lands between said notches, and said first and second plurality of discs are fixed on said first and second shafts such that each notch is interleaved between lands on discs on both sides of each notch.

9. The device as set forth in claim 1 wherein:

said first and second plurality of discs are positioned on said shafts with at least the trailing side of each notch in said first plurality of discs opposing a land area between a pair of notches in said second plurality of discs in the region where the first and second pluralities of discs overlap.

10. The device as set forth in claim 7 wherein said first and second plurality of discs are positioned on said shafts with at least the trailing side of each notch in said first plurality of discs opposing a land area between a pair of notches in said second plurality of discs in the region where the first and second pluralities of discs overlap.

* * * * *